US007882708B2

(12) United States Patent
Richter et al.

(10) Patent No.: US 7,882,708 B2
(45) Date of Patent: Feb. 8, 2011

(54) FLAT PIPE-SHAPED HEAT EXCHANGER

(75) Inventors: Rainer Richter, München (DE); Gerrit Wölk, Stuttgart (DE); Ralf Bochert, Remseck (DE); Wolfgang Kramer, Weinstadt (DE); Martin Kaspar, Esslingen (DE); Arnold Rehm, Ditzingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 1193 days.

(21) Appl. No.: 10/522,920

(22) PCT Filed: Jul. 25, 2003

(86) PCT No.: PCT/EP03/08251

§ 371 (c)(1),
(2), (4) Date: Apr. 22, 2005

(87) PCT Pub. No.: WO2004/013559

PCT Pub. Date: Feb. 12, 2004

(65) Prior Publication Data

US 2005/0229630 A1 Oct. 20, 2005

(30) Foreign Application Priority Data

Jul. 31, 2002 (DE) ..... 102 35 038

(51) Int. Cl.
*F25B 39/04* (2006.01)

(52) U.S. Cl. ..... 62/507; 62/515; 165/152; 165/153

(58) Field of Classification Search ..... 165/152, 165/153, 151, 170, 179; 62/506, 507, 515
See application file for complete search history.

(56) References Cited

U.S. PATENT DOCUMENTS 3,250,325 A 5/1966 Rhodes et al.

(Continued)

FOREIGN PATENT DOCUMENTS

EP 0 641 615 B1 1/1997

(Continued)

OTHER PUBLICATIONS

Abstract of JP 2002-90083 A to Yamaguchi et al.*

(Continued)

*Primary Examiner*—Mohammad M Ali
(74) *Attorney, Agent, or Firm*—Foley & Lardner LLP

(57) ABSTRACT

The invention relates to a heat exchanger, especially for motor vehicles, comprising a soldered heat exchanger network made of flat pipes (2,3) and corrugated ribs (1). A liquid and/or vaporous-type medium can flow through the flat tubes (2, 3) and air can circulate around the corrugated ribs. One corrugated rib respectively comprises two surfaces (4,5) which are arranged in an essentially parallel manner in relation to each other and which are connected respectively by an arch-shaped piece (6) which is soldered to a flat pipe, said arch-shaped piece comprising three sections (6*a*,6*b*,6*c*) which have different curvatures.

15 Claims, 1 Drawing Sheet

U.S. PATENT DOCUMENTS

| | | | | | |
|---|---|---|---|---|---|
| 3,724,538 | A | * | 4/1973 | Yamaguchi et al. | 165/152 |
| 4,407,358 | A | * | 10/1983 | Muellejans et al. | 165/166 |
| 5,271,458 | A | | 12/1993 | Yamamoto et al. | |
| 5,361,829 | A | * | 11/1994 | Kreutzer et al. | 165/152 |
| 5,529,116 | A | * | 6/1996 | Sasaki et al. | 165/144 |
| 5,560,425 | A | * | 10/1996 | Sugawara et al. | 165/148 |
| 6,213,196 | B1 | | 4/2001 | Ozaki et al. | |
| 6,308,527 | B1 | * | 10/2001 | Kuroyanagi et al. | 62/288 |
| 6,805,193 | B2 | * | 10/2004 | Hu et al. | 165/181 |
| 7,147,047 | B2 | * | 12/2006 | Wolk | 165/152 |
| 7,231,965 | B2 | * | 6/2007 | Shimoya et al. | 165/151 |
| 2002/0026998 | A1 | | 3/2002 | Paulman | |

FOREIGN PATENT DOCUMENTS

| | | | | |
|---|---|---|---|---|
| EP | 1 103 316 | A2 | | 5/2001 |
| EP | 1 111 318 | A1 | | 6/2001 |
| GB | 2356040 | A | | 5/2001 |
| JP | 57-127183 | A | | 8/1982 |
| JP | 58-148485 | A | | 9/1983 |
| JP | 63-61892 | A | | 3/1988 |
| JP | 1-305296 | A | | 12/1989 |
| JP | 4-049766 | A | | 2/1992 |
| JP | 2002-90083 | A | * | 3/2002 |
| WO | WO 0063631 | | | 10/2000 |

OTHER PUBLICATIONS

Translatio of JP 2002-90083 A to Yamaguchi et al.*

Abstract of Japanese published application No. 59107190 A, Jun. 21, 1984, p. 1.

* cited by examiner

FLAT PIPE-SHAPED HEAT EXCHANGER

The invention relates to a heat exchanger, in particular for motor vehicles, with a soldered heat exchanger network consisting of flat tubes and of corrugated ribs.

In the known heat exchangers for motor vehicles, such as coolant radiators, heating bodies, condensers and evaporators, the flat tubes have flowing through them a liquid and/or vaporous medium, for example a coolant or refrigerant, which discharges its heat to the ambient air or absorbs heat from the ambient air. To that extent, two very different heat capacity streams are in heat exchange with one another. In order to effect an equilibrium between the two sides, additional measures must to be taken on the air side in order to improve the heat transmission there. This is carried out by the arrangement of corrugated ribs between the flat tubes, as a result of which the heat exchange surface on the air side is enlarged. Furthermore, the surface of the corrugated ribs is slotted, that is to say equipped with gills, which break up the boundary layer flows that are formed and which bring about a deflection of the air flow from one flow duct into the other and consequently a prolongation of the flow path for the air.

Where the corrugated ribs are concerned, there are basically two different types, the V-type, as it is known, with rib surfaces arranged obliquely with respect to one another, known from U.S. Pat. No. 3,250,325. The second embodiment of the corrugated rib is what is known as the U-type, in which the rib surfaces and therefore also the gills arranged on them are oriented parallel to one another, this U-type having become known from U.S. Pat. No. 5,271,458. In thermodynamic terms, the U-type has some advantages as compared with the V-type, to be precise a relatively uniform throughflow of the approximately rectangular rib duct, a uniform flow deflection by the gills, a higher air throughput and consequently a higher heat transmission power. In manufacturing terms, the V-type is more advantageous, because various rib densities can be produced by gathering together or drawing apart the corrugated strip, while having a constant rib bending radius for the corrugation crest. By contrast, in the U-type, that is to say the parallel rib, as it is known, the rib density or the rib spacing is also fixed by the bending radius of the corrugation crest. The known parallel rib also has the disadvantage that the gill length is dependent on the rib bending radius, that is to say, the greater the radius, the shorter the gill is, this having a power-reducing effect.

It was therefore proposed to replace the rib bending radius by a flat piece which runs parallel to the tube wall and is soldered to the latter. The production of such a rectangular or meander-shaped corrugated rib is relatively complicated, corresponding production methods having been proposed in EP-B 0 641 615 and in EP-A 1 103 316. Although this "rectangular rib" has the advantage that the gills extend over almost the entire rib height (spacing from tube to tube), this is nevertheless at the expense of a high outlay in manufacturing terms.

The object of the present invention is to improve a heat exchanger of the type initially mentioned, in particular with a parallel rib, to the effect that the parallel rib has the advantages of a rectangular shape which, where appropriate, allows large gill lengths, that can however be produced at a relatively low outlay in manufacturing terms.

According to the invention, the known corrugation crest formed by a constant curvature is replaced by an arcuate piece which is composed of three portions having different curvatures. The middle portion has a comparatively low curvature, that is to say it has an almost planar design and therefore bears as much as possible against the outer surface of the tube wall.

The radius of curvature of the arcuate piece is preferably greater in the middle region than a rib height RH of the corrugated rib, especially preferably 5 to 15 times the rib height RH.

This middle portion has adjoining it two outer portions having relatively high curvatures, but in this case the two curvatures may be different, so that the entire arcuate piece has an asymmetric profile with respect to the midplane. Preferably, a first outer portion has a radius of curvature R2 which is lower than half a rib height RH of the corrugated rib, especially preferably 3 to 20% of the rib height RH. A radius of curvature R3 of the second outer portion of the arcuate piece is preferably at least as high as the radius of curvature R2 of the first portion.

This rib geometry, in particular that of the arcuate piece, can be produced relatively simply on conventional rib rollers. Furthermore, the advantages of a parallel or rectangular rib are preserved, that is to say a relatively wide soldering surface with good heat transmission and, where appropriate, a large gill length which extends over almost the entire rib height. If the rib surfaces deviate somewhat (up to about 6 degrees) from parallelism, in which case they must still be considered as essentially parallel within the scope of the invention, the thermodynamic advantages of the parallel rib are scarcely impaired thereby. The rib geometry according to the invention can be used, in particular, in motor vehicle heat exchangers, such as coolant radiators, heating bodies, condensers and evaporators.

According to an advantageous element of the invention, the rib surfaces are equipped with gills which preferably have a gill depth LP in a range of 0.5 to 1.5 mm, especially advantageously in the range of 0.7 to 1.1 mm, with a gill angle of between 20 and 35 degrees, especially advantageously between 24 and 30 degrees. Such gills have a power-increasing effect, because the deflection of the air from one duct into the adjacent duct is thereby improved, thus resulting, in turn, in a longer flow path for the air.

Further advantageous refinements of the invention yield further power increases, particularly in the case of a tube/rib system with a depth of 12 to 20 mm and with a rib density of 55 to 75 ribs/dm, this corresponding to a rib spacing or a rib division of 1.33 to 1.82 mm. The rib height for this system is in the range of 3 to 15 mm, especially preferably in the range of 6 to 10 mm.

According to an alternative advantageous development of the invention, the gill depth in the range of 0.9 to 1.1 mm with a gill angle of 23 to 30 degrees is beneficial for a tube/rib system with a depth of 40 to 52 mm and with a rib density of 45 to 65 ribs/dm, this corresponding to a rib spacing of 1.538 to 2.222 mm. The rib height for such a system is advantageously 7 to 9 mm.

Exemplary embodiments of the invention are illustrated in the drawing and are described in more detail below. In the drawing.

Figure 1:
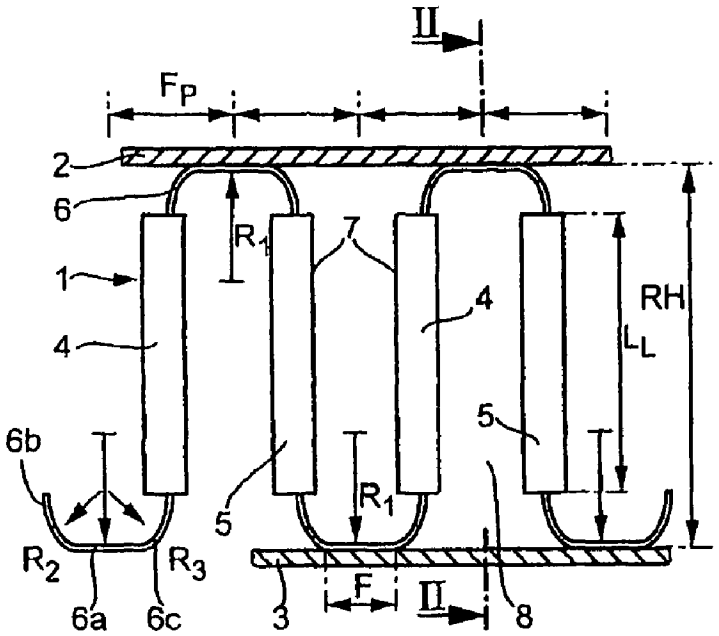
FIG. 1 shows a cross section through a parallel rib.

FIG. 1 shows what is known as a parallel rib 1 which runs between two flat tubes 2, 3, illustrated only partially. The parallel or corrugated rib 1 and the flat tubes 2, 3 form a soldered network, not illustrated, of a heat exchanger, for example of a coolant radiator for cooling an internal combustion engine of a motor vehicle or of a condenser for a motor vehicle air conditioning system. The corrugated rib 1 has in each case two planar rib surfaces 4, 5 which are arranged parallel to one another and which are connected by means of an arcuate piece 6. The arcuate piece 6 bears in each case against the flat tubes 2, 3 and is soldered to these. The planar rib surfaces 4, 5 are equipped with gills 7 which have a longitudinal extent LL. The corrugated rib 1 has a rib height RA which is greater than the gill length LL. The rib surfaces 4, 5, the arcuate piece 6 and the tube wall 2, 3 form in each case an approximately rectangular rib duct 8. The corrugated rib 1 has a defined rib density which is characterized by the rib division, that is to say the dimension FP. FP is the reciprocal value of the rib density, that is to say a rib division of FP=2 mm corresponds to a rib density of 50 ribs/dm. The arcuate piece 6 is composed of three arc portions, to be precise a middle portion 6*a* and two adjoining outer portions 6*b*, 6*c*. All three portions are formed by radii, the middle portion having a relatively high radius R1 of about 50 to 70 mm. The two outer radii R2 and R3 are considerably lower, that is to say the radius R2 is in the range of 0.4 to 0.6 mm, while the radius R3 is higher than or equal to the radius R2. R3 is in the range of 0.6 to 1.1 or 1.3 mm. This design of the arcuate piece 6 results, on the one hand, in a relatively wide soldering surface F and, on the other hand, in a relatively large gill length LL, this being beneficial for heat transmission. Furthermore, a parallel rib of this type, the arcuate piece 6 of which has said dimensions, can be produced in a simple way on conventional rib rollers.

Figure 2:
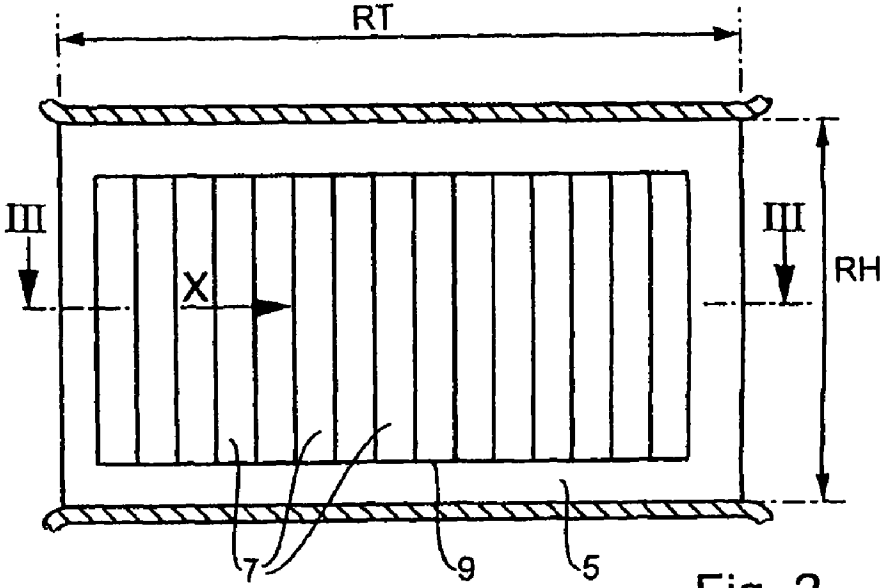
FIG. 2 shows a longitudinal section through the parallel rib in the plane of II-II according to FIG. 1.

FIG. 2 shows a longitudinal section in the plane II-II, that is to say through the rib duct 8. The rib surface 5 has a gill field 9 which is composed of a multiplicity of individual gills 7. The rib 5 has a rib depth RT, that is to say an extent in the air flow direction X.

Figure 3:
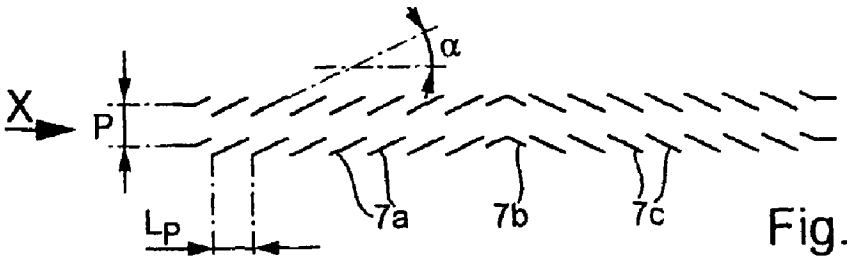
FIG. 3 shows a further longitudinal section in the plane III-III according to FIG. 2.

FIG. 3 shows a section in the plane III-III in FIG. 2, that is to say through the gill field 9 of the rib surface 5. The gill field consists of front gills 7*a* rising to the right in the drawing, of a middle roof-shaped double gill 7*b* and of rear gills 7*c* falling to the right. The gills 7*a*, 7*b*, 7*c* are in each case inclined at a gill angle α. The gills 7*a*, 7*c* have, as measured in the air flow direction X, a dimension LP which is designated as the gill depth. By means of the gills 7, the boundary layer of the air flow in the rib ducts is broken up and deflected from one rib duct 8 into the adjacent rib duct. This results, for the air flow, in a longer flow path which increases heat transmission. The deflection of the air flow is dependent on the gill angle α and on the gill depth LP.

According to the invention, two preferred exemplary embodiments having the following dimensions are optimal for the parallel rib described above:

First Exemplary Embodiment

The first exemplary embodiment relates to a condenser for an air conditioning system of a motor vehicle. Thus, refrigerant, for example R134a, flows through the flat tubes of the condenser. A heat exchanger network consisting of flat tubes and of a parallel rib having the following dimensions is provided for such a condenser:

Rib depth RT: 12≦RT≦20 mm,
Rib division FP: 1.33 mm≦FP≦1.818 mm,
corresponding to a rib density of 55 to 75 ribs/dm,
Gill angle α: 24°≦α≦30°,
Gill length LL: 6.4 mm≦LL≦7.2 mm,
Rib height RH: 6 mm≦RH≦10 mm,
Gill depth LP: 0.7 mm≦LP≦1.1 mm,
Ratio of gill depth LP to rib division FP: 0.385≦LP/FP≦0.825,
Radius of curvature R1 of the middle arcuate piece portion: 50 mm≦R≦70 mm,
Radius of curvature R2 of the first outer arcuate piece portion: 0.4 mm≦R2≦0.6 mm,
Radius of curvature R3 of the second outer arcuate piece portion: 0.6 mm≦R3≦1.1 mm.

A parallel rib system having the abovementioned dimensions is superior to a conventional rib system with a rib arranged in a V-shaped manner in many respects, specifically with regard to the air throughput, the flow deflection, the homogenization of the flow velocity and temperature profile and therefore the heat transmission power.

Second Exemplary Embodiment

The second exemplary embodiment relates to a coolant refrigerator which is installed in motor vehicles in the coolant circuit for cooling the internal combustion engine and through which coolant, that is to say a water/glysantine mixture, flows. Parallel ribs having the following dimensions are provided between the flat tubes preferably arranged in a row:

Rib depth RT: 40≦RT≦52 mm,
Rib division FP: 1.538≦FP≦2.222 mm,
corresponding to a rib density of 45 to 65 ribs/dm,
Gill angle α: 23°≦α≦30°,
Gill length LL: 6.5≦LL≦7.2 mm,
Rib height RH: 7≦RH≦9 mm,
Gill depth LP: 0.9≦LP≦1.1 mm,
Ratio of gill depth LP to rib division LP: 0.405≦LP/FP≦0.715,
Radius of curvature R1 of the middle arcuate piece portion: 50 mm≦R1≦70 mm,
Radius of curvature R2 of the first outer arcuate piece portion: 0.4 mm≦R2≦0.6 mm,
Radius of curvature R3 of the second outer arcuate piece portion: 0.6 mm≦R3≦1.3 mm.

This system, too, which is substantially deeper than the first exemplary embodiment, affords a marked increase in power in relation to a comparable V-rib.

The invention claimed is:

1. A heat exchanger, comprising:

a soldered heat exchanger network comprising flat tubes and corrugated ribs configured so that a liquid and/or gaseous medium can flow through the flat tubes and air can flow around the corrugated ribs, and a corrugated rib having at least two rib surfaces which are arranged essentially parallel to one another and are connected by an arcuate piece joined to a flat tube, wherein the arcuate piece has a lower curvature in a middle portion than in a first outer portion and in a second outer portion, wherein the arcuate piece has in the middle portion a radius of curvature R1 which is greater than a rib height RH of the corrugated rib, wherein the arcuate piece has in the first outer portion a radius of curvature R2 which is lower than half a rib height RH of the corrugated rib.

2. The heat exchanger as claimed in claim 1, wherein the rib surfaces include gills, wherein the gills are arranged as louvers.

3. The heat exchanger as claimed in claim 1, wherein the arcuate piece has in the second outer portion a radius of curvature R3 which is greater than or equal to a radius of curvature R2 in the first outer portion.

4. The heat exchanger as claimed in claim 1, wherein the arcuate piece has in the second outer portion a radius of curvature R3 which is lower than a rib height RH of the corrugated rib.

5. The heat exchanger as claimed in claim 2, wherein the gills have a gill depth LP in a range of 0.5 to 1.5 mm and a gill angle in a range of 20° to 35°.

6. The heat exchanger as claimed in claim 1, wherein the corrugated rib has a rib division FP in a range of 1 to 3 mm.

7. The heat exchanger as claimed in claim 1, wherein the corrugated rib has a rib depth RT in a range of 10 to 70 mm.

8. The heat exchanger as claimed in claim 2, wherein a ratio of gill depth LP to rib division FP is in a range of 0.385 to 0.825.

9. The heat exchanger as claimed in claim 1, wherein the corrugated rib has a rib height RH in a range of 3 to 15 mm.

10. The heat exchanger as claimed in claim 1, wherein the arcuate piece is soldered to the flat tube.

11. The heat exchanger as claimed in claim 7, wherein the rib depth RT is in a range of 12 to 20 mm.

12. The heat exchanger as claimed in claim 7, wherein the rib depth RT is in a range of 40 to 64 mm.

13. The heat exchanger as claimed in claim 9, wherein the rib height RH is in a range of 6 to 10 mm.

14. The heat exchanger as claimed in claim 1, wherein the heat exchanger is a coolant refrigerator or condenser for a motor vehicle.

15. The heat exchanger as claimed in claim 1, wherein the corrugated rib includes flat portions.

* * * * *